US006036177A

United States Patent [19]

Kirkwood, Jr.

[11] Patent Number: 6,036,177

[45] Date of Patent: Mar. 14, 2000

[54] KEYED DECKING SYSTEM AND METHOD

[76] Inventor: James B. Kirkwood, Jr., 424 S. Holden St., Clarksburg, W. Va. 26301

[21] Appl. No.: 09/054,412

[22] Filed: Apr. 3, 1998

Related U.S. Application Data

[60] Provisional application No. 60/057,772, Sep. 5, 1997.

[51] Int. Cl.[7] ..... E04H 17/14

[52] U.S. Cl. ..... 256/59; 256/65; 256/24; 52/650.3

[58] Field of Search ..... 256/59, 19, 65, 256/68, 70, 24; 52/650.3, 667, 668

[56] References Cited

U.S. PATENT DOCUMENTS

| | | | |
|---|---|---|---|
| 1,135,817 | 4/1915 | Klein et al. . | |
| 1,429,084 | 9/1922 | Loeffler . | |
| 3,879,017 | 4/1975 | Maxcy et al. | 256/65 |
| 3,991,982 | 11/1976 | Yamamoto | 256/65 |
| 4,796,866 | 1/1989 | Garneau . | |
| 5,469,678 | 11/1995 | Zamerovsky | 52/650.3 X |
| 5,611,523 | 3/1997 | Parisien | 256/68 |
| 5,794,390 | 8/1998 | Oliveri et al. | 256/19 X |
| 5,862,642 | 1/1999 | Erwin | 256/19 X |

*Primary Examiner*—Lynne H. Browne
*Assistant Examiner*—John R. Cottingham
*Attorney, Agent, or Firm*—Richard C. Litman

[57] ABSTRACT

A keyed decking system for supporting a handrail on a deck surface and a method of making same. Keyed rail and end support posts are easily constructed by adding a modified mortise and tenon joint to currently available rail and end posts. The use of this joint not only increases the strength of a handrail built therewith, but also increases the speed of building the handrail as well. In addition, by increasing the overall strength of the handrail, aesthetic considerations can be given more freedom thereby resulting in a wider range of deck and handrail designs. The slots used to make the modified mortise and tenon joint are sized to accept ¾"×6" standard decking material used as rails. Keyed rail posts are used at the corners and in place of some of the balusters at locations no greater than three feet apart. Keyed end or gate posts are used wherever a gap in the handrail occurs (at gate locations or ends of the handrail).

9 Claims, 2 Drawing Sheets

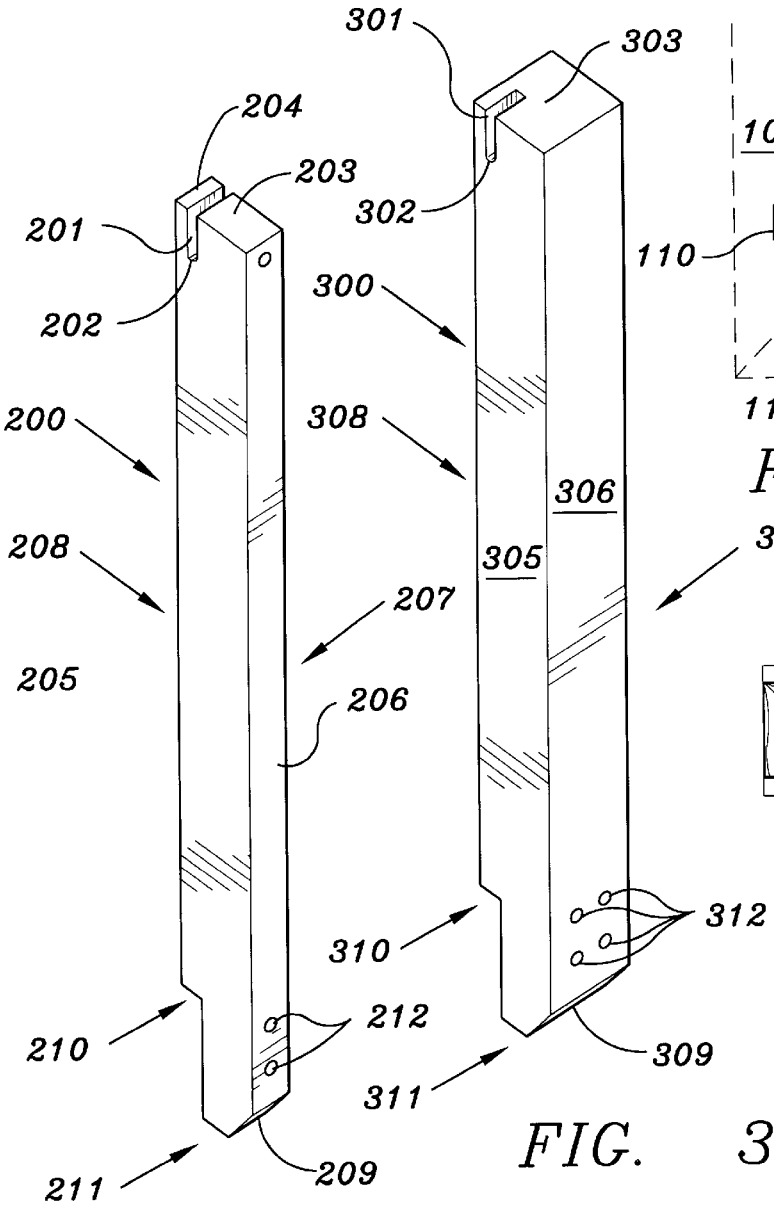
FIG. 2
FIG. 3
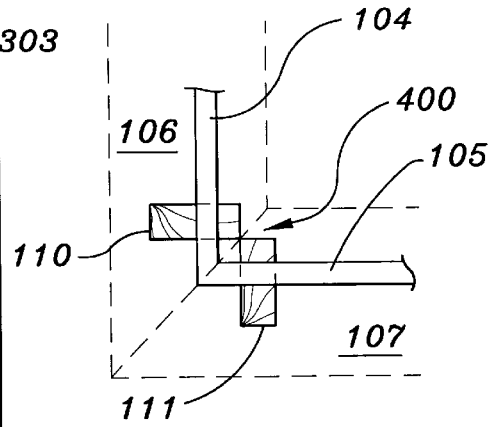
FIG. 4
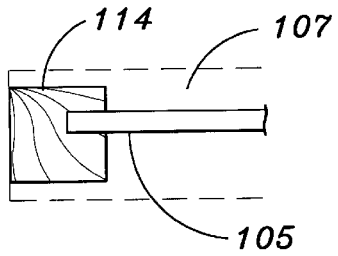
FIG. 5

KEYED DECKING SYSTEM AND METHOD

CROSS-REFERENCE TO RELATED APPLICATION

This application claims the benefit of U.S. Provisional Patent Application Ser. No. 60/057,772, filed Sep. 5, 1997.

BACKGROUND OF THE INVENTION

1. Field of the Invention

The present invention relates to decks, porches and other platforms made of wood or wood substitutes, and more specifically, to a system of keyed posts for strengthening handrail assemblies on decks.

2. Description of Related Art

Decks have continued to rise in popularity in recent years. Some of the decks presently being built, as well as many pre-existing decks, include a deck surface substantially high in elevation relative to the ground. To avoid injury caused to a person who may fall off of the deck surface, handrails are installed around the outer perimeter of the deck. These handrails are usually supported by a number of balusters and corner posts, and in many cases are somewhat unstable due to poor construction and wear and tear (often caused by individuals leaning against them).

The present invention obviates this problem by increasing the strength of handrail connections using a modified mortise and tenon joint. The use of this type of joint has been heretofore unknown in the decking industry. The prior art has generally taught away from the use of mortises in decking because of the theory that this type of joint is more susceptible to decay.

U.S. Pat. No. 1,135,817 issued on Apr. 13, 1915 to Klein et al., discloses a post for office railings and the like wherein the posts have longitudinal bores for receiving rods extending through the floor, or sockets or other footings to clamp the posts to a building floor. The bottom rails are fitted to the post by a mortise and tenon joint and the top rails are clamped to the posts by hardware and also secured by dowels.

U.S. Pat. No. 1,429,084 issued on Sep. 12, 1922 to Loeffler, describes a fence post with a slot in the top to accept a horizontal fence rail. The walls of the slot are not parallel, rather one wall is "obliquely disposed", so that rails may be placed between adjacent posts by inserting one end of the rail obliquely in one slot and adjusting the other end of the rail in the slot of an adjacent post. The post is preferably made of concrete and sunk in the ground. The rail is prevented from slipping out of the slot by nailing a block of wood to the rail adjacent the post.

U.S. Pat. No. 4,796,866 issued on Jan. 10, 1989 to Garneau discloses a railing structure designed to hide the fasteners used to construct the railing. The posts, balusters, and rails are made from a soft wood, press wood or plastic core with hardwood facing plates glued or adherently attached to the core. Rails are attached to "uprights at the end of a railing" by a screw extending into the core.

None of the above inventions and patents, taken either singly or in combination, is seen to describe the instant invention as claimed.

SUMMARY OF THE INVENTION

As decks have risen in popularity, the materials for building these decks (and their associated handrails) have become more readily available. The keyed rail posts and end posts used in the present invention, are easily constructed using currently available rail and end posts. The term "keyed" as used in this context refers to a modified mortise and tenon joint cut into commercially available posts. The use of this joint not only increases the strength of a handrail built therewith, but increases the speed of building the handrail as well. In fact, it is believed that the present method can save 30–50% of the time required for building the handrail. In addition, by increasing the overall strength of the handrail, aesthetic considerations can be given more freedom thereby resulting in a wider range of deck and handrail designs.

The commercially available lumber (or synthetic) components used in the present invention (in a preferred embodiment) include: 2"×4"×42"s; 4"×4"×42"s; and 5/4"×6" standard decking material. To prepare each 2"×4"×42" for use, a 5 7/16"×1" slot with a ½" radius bottom is cut across the top thereof, and a 1½"×6" rabbet is cut into the bottom thereof. Each 4"×4"×42" is prepared by cutting a 5 7/16"×1" slot 1¼" across the top thereof, and by cutting a 1½"×6" rabbet into the bottom thereof. The slots are sized to accept the 5/4"×6" standard decking material (noting that actual lumber sizes are based on pre-drying dimensions) which is rounded on one edge. Both the 2"×4"×42"s and the 4"×4"×42"s are available with a bevel on the bottom edge thereof which matches a bevel on 2"×2"×42" standard balusters.

The handrail assembly method may be used to install a handrail on any horizontal surface supported by a frame with an exterior surface flush with the edge of the horizontal surface. Therefore it should be noted that the term deck is not intended to be limiting, but applies to decks, porches, balconies, etc. To install the handrail the bottoms of the keyed rail posts are attached to the external surface of the header or facing boards. The keyed rail posts are first installed in pairs at the corners of the deck. Corners are considered any location where the perimeter of the deck changes direction. The corner construction results in each corner having two keyed support posts with their interior edges abutting one another. After attaching the keyed rail posts to the corners of the deck, end locations (such as where the deck abuts another structure) and gate locations are determined, and keyed end posts (keyed rail posts may also be used here) are attached to these locations.

The distance between corners and end or gate posts is then measured to determine the placement of balusters. Keyed rail posts are used in place of some of the balusters at locations no greater than three feet apart (for added strength). Once all of the keyed posts have been attached to the deck surface, the rail boards are inserted into the slots of the keyed posts. Glue is applied to the slots prior to inserting the rail boards, and screws are driven into the tops of the keyed posts and through the rail boards for additional strength. After installing the rail boards, the 2"×2" balusters are attached using deck screws (with glue optional) and the horizontal rail caps are attached using #6 ×2" coarse thread deck screws.

Accordingly, it is a principal object of the invention to increase the strength of a handrail while maintaining the aesthetic appearance thereof.

It is another object of the invention to provide a method of assembling a handrail in 30–50% less time than was previously needed.

It is a further object of the invention to allow a greater degree in deck design flexibility by providing a stronger overall handrail assembly.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 2 is an isometric view of a keyed rail post used in the decking system of FIG. 1.

FIG. 3 is an isometric view of a keyed end or gate post used in the decking system of FIG. 1.

FIG. 4 is a partial top, plan view of the corner of the keyed decking system, including two of the keyed rail posts.

FIG. 5 is a detail view of an end of the keyed decking system, including the keyed end or gate post.

Similar reference characters denote corresponding features consistently throughout the attached drawings.

DETAILED DESCRIPTION OF THE PREFERRED EMBODIMENT

Figure 1:
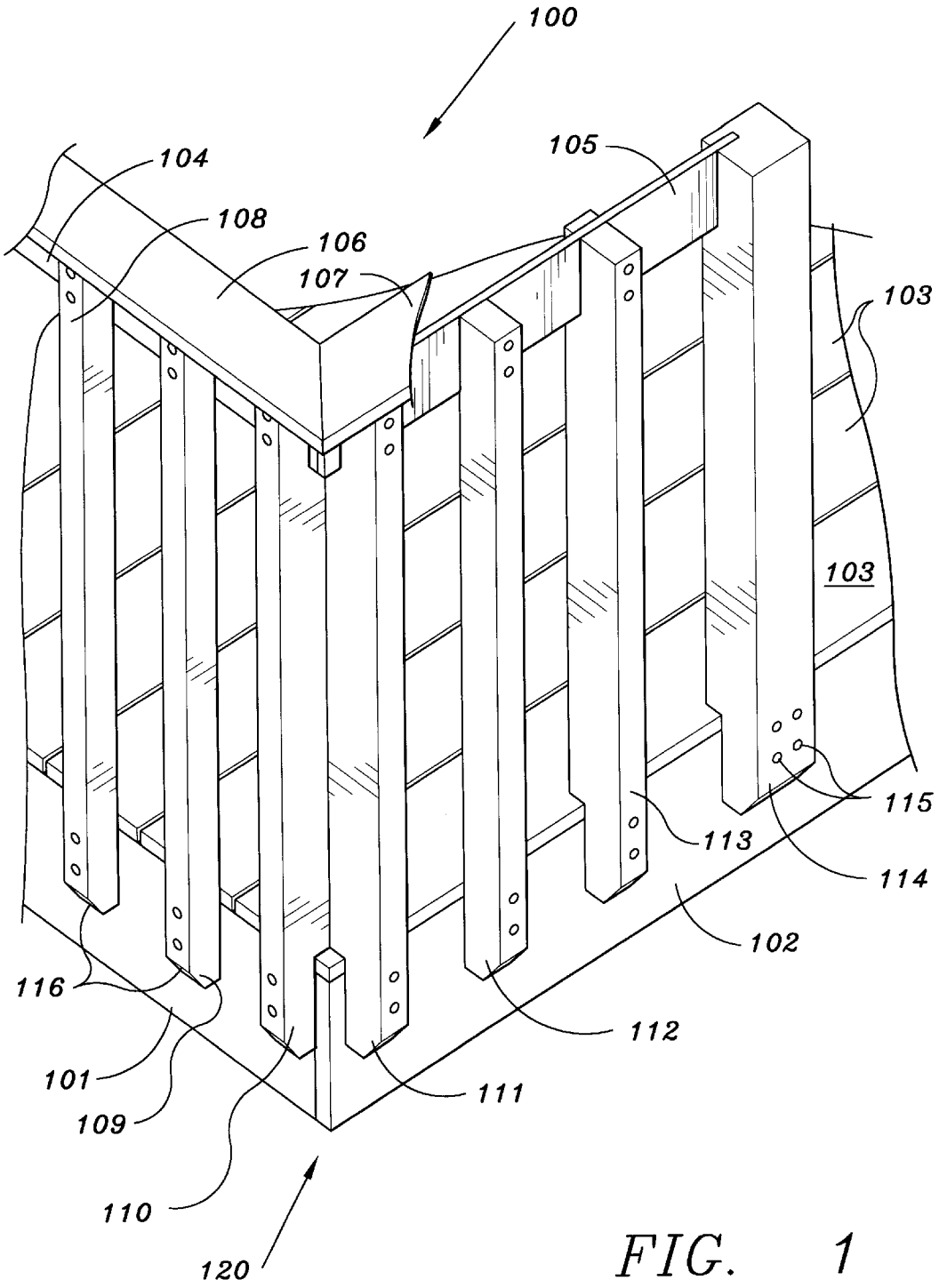
FIG. 1 is a partial isometric view of a corner of the keyed decking system of the present invention, with a portion cut away to reveal interior detail.

FIG. 1 shows a corner assembly of a decking system 100 built by the method and using the keyed posts of the present invention. A first lateral facing board 101 is attached to a second longitudinal facing board 102 to form a corner 120. It should be noted that while corner 120 is shown as a 90° corner, any desired angle (including curves) may be formed using the method described below. The deck substructure may include a plurality of footings, piers, posts, ledgers, joists, beams and header or facing boards, as is well known in the art. The deck surface is completed by attaching a plurality of deck boards 103 to the top surface of the joists or deck substructure. While the deck boards 103 are shown parallel to the facing board 102, their orientation is not critical, and in some cases they are installed at a 45° angle to the headers or facing boards for aesthetic purposes.

The main thrust of the present invention involves the support structure for the handrail of the deck. The material used for the deck is not of concern, as the method and keyed posts used in the present invention are suitable for use with many different materials. These include but are not limited to: pressure treated lumber; cedar; redwood; metals; and synthetic building products.

In normal practice, a plurality of 2"×2" balusters 108, 109 and 112 are used to support rail boards 104 and 105. The bottom of these balusters are attached (using wood screws with glue optional) to exterior surfaces of the lateral facing board 101 and the longitudinal facing board 102, while the top of the balusters are attached to the exterior surfaces of rail boards 104 and 105. Unfortunately, while these top connections provide an adequate amount of vertical strength, the horizontal strength of these connections is minimal.

To overcome this deficiency, keyed rail posts 110, 111 and 113 and keyed end or gate posts 114 are provided to increase the horizontal strength of the handrail. These keyed posts 110, 111, and 113 are standard 2"×4"×42", (4"×4" for the end posts 114) treated decking material having a slot mortised into their top ends. As is best shown in FIG. 2, the keyed rail posts 110, 111 and 113 (labeled as 200 in FIG. 2) include a slot 201 for receiving and supporting the rail boards 104 and 105. The slot 201 divides the top surface of the keyed rail post 200 into two portions 203 and 204. This slot is 1" wide and 5 7/16" from top to bottom to accept a standard ¾"×6" rail board. The bottom 202 of the slot 201 is rounded with a ½" radius to mate with the rounded bottom of the rail boards 104 and 105. The keyed rail post 200 also includes an exterior surface 206, an interior surface 208, a left hand surface 205, a right hand surface 207 and a bottom surface 211. The bottom of the exterior surface 206 includes a bevel 209 for aesthetics to match the bevel 116 on the bottom of the balusters 108, 109, and 112. The bottom of the interior surface 208 includes a rabbet or notch 210 that provides a support surface that rests on the top of deck boards 103. Rabbet 210 is cut 1½" into interior surface 208, and is 6" from top to bottom. Fasteners 212, (standard course thread wood screws being preferred) are used to attach the keyed rail post 200 to the deck frame board.

FIG. 3 illustrates the details of the keyed end or gate post 300 (shown as 114 in FIG. 1). The keyed end post 300 includes a slot 301 for receiving and supporting the rail boards 104 and 105. The slot 301 extends only 1¼" across top surface 303. The slot 301 is 1" wide and 5 7/16" from top to bottom to accept a standard ¾"×6" rail board. The bottom 302 of the slot 301 is rounded with a ½" radius to mate with the rounded bottom of the rail boards 104 and 105. The keyed end post 300 also includes an exterior surface 306, an interior surface 308, a left hand surface 305, a right hand surface 307 and a bottom surface 311. As with the keyed rail post 200, the bottom of the exterior surface 306 includes a bevel 309 for aesthetics. The bottom of the interior surface 308 includes a rabbet or notch 310 that provides a support surface that rests on the top of deck boards 103. Rabbet 310 is cut 1½" into interior surface 308, and is 6" from top to bottom. Fasteners 312, are also used to attach the keyed end post 300 to the deck facing board.

The method of assembling the handrail according to the present invention proceeds as follows. After completing the deck surface as described above, the bottom of a keyed rail post 110 is attached to the external surface of the lateral facing board 101 at a point adjacent the corner 120. The post 110 is preferably attached using both glue and wood screws (#6 ×3½"), however other known methods of attaching wood components may be used. The bottom of another keyed rail post 111 is attached to the longitudinal facing board 102, also at a point adjacent the corner 120. This procedure is repeated for all corners of the deck that will also include a corner of the handrail (i.e. not normally locations where the deck abuts another structure). This results in each corner having two keyed support posts with their interior edges abutting one another as best shown at 400 in FIG. 4.

After attaching the keyed rail posts 110 and 111 to the deck, end locations (such as where the deck abuts another structure) and gate locations are determined. A keyed end post 114 is attached to the deck in the same manner as the keyed rail posts, 110 and 111, at each end location. At locations where it is desired to have a gate, a keyed end post 114 is attached to the deck on both sides of the future gate. If the use of 4"×4" end or gate posts 114 is not desirable aesthetically or otherwise, the 2"×4" keyed rail posts 110, and 111 may be used in place of the keyed end posts 114.

The distance between corners 120 and end or gate posts 114 is then divided into three foot increments, and a mark is made to note these locations. It should be noted that three feet is the maximum distance suggested between keyed posts 110, 111 and 114, although for aesthetic purposes the actual placement of the keyed post 113 is dependent on the distance between balusters 108, 109 and 112. In other words, the balusters 108, 109 and 112 are usually equally spaced, therefore, the placement of keyed post 113 is also dependent on the eventual placement of the balusters 108, 109, and 112. As with the corner posts 110 and 111, keyed rail post 113 is attached to the exterior surface of the facing board 102 at the marked location.

Once all of the keyed posts 110, 111, 113, and 114 have been attached to the deck surface, the rail boards 104 and 105 are inserted into the slots of the keyed posts 110, 111, 113, and 114. Glue is applied to the slots prior to inserting the rail boards 104 and 105, and screws are driven into the tops of the keyed posts 110, 111, 113 and 114 and through the rail boards 104 and 105 for additional strength.

In the case of a 90° corner, the rail boards 104 and 105 form a strong conventional butt joint, which may be secured with appropriate fasteners. Similarly, in the case of a 45° degree corner, the rail boards 104 and 105 form a conventional miter joint, which may be secured by appropriate fasteners. Thus the deck corners have a reinforced or supported corner joint comprising a conventional joint formed by the ends of the rail boards 104 and 105, supported or reinforced by a joint similar to an open mortise and tenon between the rail board 104 or 105 and a keyed rail post 110 or 111. After installing the rail boards 104 and 105, the 2"×2" balusters 108, 109 and 112 are attached using deck screws ( with glue optional) and the horizontal rail caps (shown as 106 and 107 in FIG. 1) are attached using #6 ×2" coarse thread deck screws, closing the "open mortise".

It is to be understood that the present invention is not limited to the embodiment described above, but encompasses any and all embodiments within the scope of the following claims.

I claim:

1. A keyed handrail system for a horizontal surface having a plurality of facing boards, said keyed handrail system comprising:

a) at least one horizontal rail board having a top surface, a bottom surface, an internal side surface, an external side surface, and two end surfaces;

b) a plurality of balusters, each said baluster having a top end and a bottom end, the top end of each said baluster being attached to said at least one horizontal rail board and the bottom end of each said baluster being adapted for attachment to one of the facing boards;

c) a plurality of keyed rail posts, each said keyed rail post having a top, a bottom, an interior surface, an exterior surface, and two side surfaces, the top of each said keyed rail post having a slot extending completely across said top, wherein:

(i) said slot is parallel to the interior and exterior surfaces of said keyed rail post and extends through the side surfaces of said keyed rail post;

(ii) said bottoms of said plurality of keyed rail posts are adapted for attachment to one of the facing boards; and (iii) said slots are dimensioned and configured for receiving and supporting said at least one horizontal rail board;

d) a plurality of cap boards attached to the tops of said plurality of keyed rail posts; and wherein e) said at least one rail board extends longitudinally between, is disposed within, and is attached to the slots of adjacent said keyed rail posts.

2. The keyed handrail system according to claim 1, wherein:

a) said at least one horizontal rail board includes a first and second horizontal rail board, one of the ends of said first horizontal rail board being attached to one of the ends of said second horizontal rail board to form a handrail corner;

b) said plurality of keyed rail posts includes a first keyed rail post and a second keyed rail post;

c) the slot in said first keyed rail post is configured and dimensioned for receiving and supporting said first horizontal rail board adjacent said handrail corner; and d) the slot in said second keyed rail post is dimensioned and configured for receiving and supporting said second horizontal rail board adjacent said handrail corner, whereby the interior surface of said first keyed rail post and the interior surface of said second keyed rail post are abutting at said handrail corner.

3. The keyed handrail system according to claim 2, further comprising:

a) at least one keyed end post having a top, a bottom, an interior surface, an exterior surface, and two side surfaces, the top of said at least one keyed end post having an end slot extending partially across said top, said end slot being parallel to said interior and exterior surfaces and extending into one of said side surfaces; and b) wherein the end slot of said at least one keyed end post is dimensioned and configured to receive and support said at least one horizontal rail board at one of the end surfaces of said at least one horizontal rail board.

4. A keyed decking system comprising:

a) a deck substructure including a plurality of facing boards;

b) a plurality of decking boards attached to said deck substructure in order to form a horizontal deck surface;

c) at least one horizontal rail board having a top surface, a bottom surface, an internal side surface, an external side surface, and two end surfaces;

d) a plurality of balusters, each having a top end and a bottom end, the top ends of said plurality of balusters being attached to said at least one horizontal rail board and the bottom ends of said plurality of balusters being attached to one of said facing boards;

e) a plurality of keyed rail posts, each having a top, a bottom, an interior surface, an exterior surface, and two side surfaces, the top of each said keyed rail post having a slot extending completely across said top, wherein:

(i) said slots are parallel to said interior and exterior surfaces of said keyed rail post and extend through said keyed rail post;

(ii) the bottoms of said plurality of keyed rail posts are attached to one of said facing boards; and (iii) said slots receive and support said at least one horizontal rail board.

5. The keyed decking system according to claim 4, wherein:

a) said at least one horizontal rail board includes a first and second horizontal rail board, said first horizontal rail board being attached to said second horizontal rail board to form a handrail corner;

b) said plurality of keyed rail posts includes a first keyed rail post and a second keyed rail post;

c) the slot in said first keyed rail post receives and supports said first horizontal rail board adjacent said handrail corner; and (d) the slot in said second keyed rail post receives and supports said second horizontal rail board adjacent said handrail corner.

6. The keyed decking system according to claim 5, further comprising:

a) at least one keyed end post having a top, a bottom, an interior surface, an exterior surface, and two side surfaces, the top of said at least one keyed end post having an end slot extending partially across said top, the end slot being parallel to said interior and exterior surfaces and extending into one of said side surfaces; and b) wherein the end slot of said at least one keyed end post receives and supports said at least one horizontal rail board at one of the end surfaces of said at least one horizontal rail board.

7. A keyed rail post for a handrail assembly, comprising a post measuring substantially 2"×4"×42" having a top end and a bottom end, an interior surface, an exterior surface, and two side surfaces, the top end having a slot mortised therein extending through the side surfaces, the depth of the slot extending the width of said post, the slot measuring substantially 1" in width by 5⁄16" in length with a ½" radius cut at the base of the slot, the slot having a first edge substantially ¾" from the interior surface of said keyed rail post and a second edge substantially 1¾" from the interior surface of said post, and the bottom end having a rabbet groove defined on the interior surface of said post measuring substantially 1½" in depth, 6" in length, and extending the width of said post.

8. A keyed end post for a handrail assembly, comprising a post measuring substantially 4"×4"×42" having a top end and a bottom end, an interior surface, an exterior surface, and two side surfaces, the top end having a slot mortised through a side surface, the depth of the slot extending substantially 1¼" into the width of said post, the slot measuring substantially 1" in width by 5⁄16" in length with a ½" radius cut at the base of the slot, the slot having a first edge substantially ¾" from the interior surface of said keyed end post and a second edge substantially 1¾" from the interior surface of said post, and the bottom end having a rabbet groove defined on the interior surface of said post measuring substantially 1½" in depth, 6" in length, and extending the width of said post;

provided that said keyed end post has only one slot defined therein, said post being adapted for receiving an end of a single horizontal rail board at a terminus of a handrail system.

9. A reinforced corner joint for a handrail assembly, comprising:

a) a first keyed rail post according to claim 7;

b) a second keyed rail post according to claim 7, the interior surface of said first keyed rail post abutting the interior surface of said second keyed rail post;

c) a first rail board having a first end and a second end, the first rail board being disposed within the slot of said first keyed rail post;

d) a second rail board having a first end and a second end, the second rail board being disposed within the slot of said second keyed rail post; wherein e) the first end of said first rail board extends beyond the slot of said first keyed rail post and the first end of said second rail board extends beyond the slot of said second keyed rail post in order to form a conventional joint between the first ends of said rail boards; and f) said first rail board is fastened to said first keyed rail post at the slot in said first keyed rail post and said second rail board is fastened to said second rail post at the slot in said second keyed rail post.

* * * * *